US006499641B2

(12) United States Patent
Dadd

(10) Patent No.: US 6,499,641 B2
(45) Date of Patent: Dec. 31, 2002

(54) ROPE SYSTEM

(75) Inventor: James Dadd, North Delta (CA)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 09/903,468

(22) Filed: Jul. 11, 2001

(65) Prior Publication Data

US 2002/0005426 A1 Jan. 17, 2002

(30) Foreign Application Priority Data

Jul. 12, 2000 (DE) ..... 200 12 301 U

(51) Int. Cl.[7] ..... G03B 1/56; B65H 43/00; B65H 23/24; B65H 77/00

(52) U.S. Cl. ..... 226/91; 226/10; 242/417.1; 242/419.3; 242/419.7

(58) Field of Search ..... 226/91, 92, 10, 226/45; 242/417.1, 419.3, 419.7, 562.1, 532.7

(56) References Cited

U.S. PATENT DOCUMENTS

| | | | | | |
|---|---|---|---|---|---|
| 3,882,748 | A | * | 5/1975 | Moore | 114/221 A |
| 3,962,943 | A | * | 6/1976 | Allen | 83/360 |
| 4,480,801 | A | * | 11/1984 | Stone | 101/228 |
| 5,257,465 | A | * | 11/1993 | Marx, Jr. | 34/117 |
| 5,263,623 | A | * | 11/1993 | Bracken | 226/118.2 |
| 5,375,753 | A | * | 12/1994 | Barthauer et al. | 226/118.2 |
| 5,377,892 | A | | 1/1995 | Kimball | 226/92 |
| 5,992,721 | A | * | 11/1999 | Craft et al. | 226/118.2 |
| 6,241,138 | B1 | * | 6/2001 | Garrigan et al. | 162/193 |
| 6,276,519 | B1 | * | 8/2001 | Craft et al. | 198/813 |

* cited by examiner

*Primary Examiner*—Michael R. Mansen
*Assistant Examiner*—Minh-Chau Pham
(74) *Attorney, Agent, or Firm*—Taylor & Aust, P.C.

(57) ABSTRACT

A rope system includes an endless rope, a measuring device and a rope cutter. The endless rope is configured to travel through a machine, while the endless rope is under tension. The measuring device is used to measure the tension in the endless rope. The rope cutter is positioned to sever the endless rope if the tension exceeds a predetermined value.

11 Claims, 2 Drawing Sheets

ROPE SYSTEM

BACKGROUND OF THE INVENTION

1. Field of the Invention

The present invention relates to a rope system and more particularly, an endless rope which is arranged to travel through a machine while being tensioned in its longitudinal direction.

2. Description of the Related Art

In conventional rope systems, sometimes there is a danger that a rope gets stuck or that a rope is inadvertently wrapped around a drying cylinder or around a roll. This may result in serious damage to the equipment, e.g. to the rope tensioning device or to other elements of the rope system.

In the paper technology, in particular in paper or cardboard making machines or in paper or cardboard finishing machines, a rope system is often used for threading the paper or cardboard web into the machine (in particular into the drying section) when the machine is started up or after a web break. Basically, two (sometimes three) endless ropes are used which travel together along the web travel path through a drying section, a calendar section or a coating section. At the upstream end of a section, the two ropes form a rope nip. At this point, the ropes grip the beginning of an edge strip (a so-called "tail") of the paper or cardboard web and transfer the edge strip through the section.

What is needed in the art is a rope system wherein the potential of damage to the equipment is eliminated or at least reduced.

SUMMARY OF THE INVENTION

The present invention provides a rope system and method for using a rope system that includes a measuring device for measuring the tension value in at least one endless rope. Preferably, the tension value is measured continuously during operation of the machine.

The measuring device is adapted to detect excessive tension, which is above the desired tension value normally maintained in the rope. Excessive tension may appear if the rope gets stuck or if other damage occurs to the rope system.

According to one embodiment of the invention, a rope cutter is provided for severing the endless rope if the rope suddenly is excessively tensioned. The rope cutter becomes immediately active when excessive tension is detected.

Generally, after severing the rope, the paper making machine is able to continue operating in the normal way because any danger of damage to the machine has been eliminated. Certainly, some loss arises from severing the rope. However, this loss is inconsequential in comparison to the damage that would occur to the mechanical equipment if the rope was not cut.

Preferably, the rope system of the present invention includes a rope tensioning device with a cylinder which is adapted to move at least one sheave, that is wrapped by the rope, for tensioning the rope. A selected pressure will be supplied to the cylinder which corresponds to the desired tension value. The measuring device is adapted to measure the prevailing pressure in the cylinder. The measuring device may be embodied as a pressure switch which creates a signal if the pressure in the cylinder exceeds the selected pressure. That signal will then be transmitted to the rope cutter.

In one embodiment of the invention, the rope cutter includes a cylinder for actuating the rope cutter. A control valve may be provided to control the cylinder such that the cylinder actuates the rope cutter when the signal exists. In a preferred embodiment of the invention, the control valve is controlled by a pressure fluid (e.g. compressed air) which is admitted to the control valve when the signal exists.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
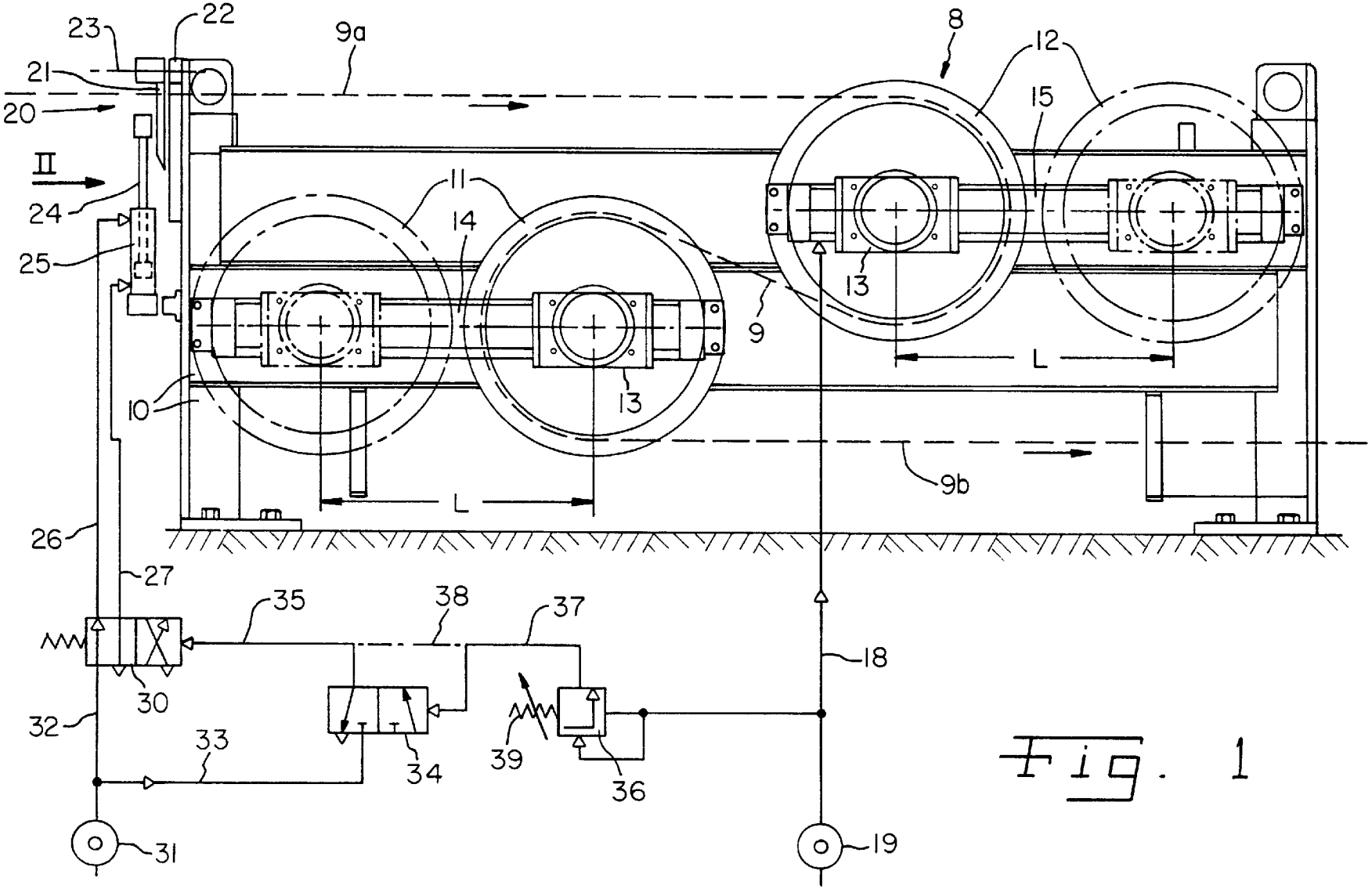
FIG. 1 shows a section of a rope system, namely a rope tensioning device including a rope cutter according to the invention.

Referring now to the drawings, and more particularly to FIG. 1, there is shown a rope tensioning device 8 of the rope system including two movable sheaves 11 and 12 which support rope 9*a*, 9 and 9*b*. As an example, rope 9*a* is the incoming run and rope 9*b* is the outgoing run of rope 9. The arrangement is such that, where rope 9*a*, 9 and 9*b* wraps sheaves 11 and 12, rope 9*a*, 9 and 9*b* form a single S (or an inverted S). Sheaves 11 and 12 are movable from an initial position, shown in full lines, away from each other, each by a distance L, into a final position as shown in dot-dash-lines, thereby extending rope 9 by a length of four times distance L.

In another embodiment of the invention, the tension device may include only one movable sheave.

Rope tensioning device 8 (FIGS. 1 and 2) includes a stationary frame 10 supporting two rodless pneumatic cylinders 14 and 15. Each cylinder 14 and 15 having a movable piston (not shown) to which sheave support 13 is connected. Sheave supports 13 are adapted to support rotatable sheaves 11 and 12 (e.g. by antifriction bearings).

In yet another embodiment of the invention rope tensioning device 8 will be positioned in a paper-making machine in which rope 9 is used. In the paper-making machine, the tensioning device may be arranged horizontally (as shown in FIG. 1), vertically, upside down or in any other orientation. Two or more tensioning devices may be combined in order to tension a twin-rope-system or a three-rope-system. Usually, each rope forms an endless loop traveling at the operating speed of the paper-making machine.

At the infeed end of rope tensioning device 8 (close to the incoming run 9*a* of rope 9), rope cutter 20 is mounted on frame 10. Rope cutter 20 includes a pivotable knife 21 which is adapted to cooperate with stationary counter knife 22. Knife 21 is pivotable around an axle having an axis 23. Also, knife 21 is coupled to piston 24 of a double acting pneumatic cylinder 25 which is coupled to frame 10.

Figure 2:
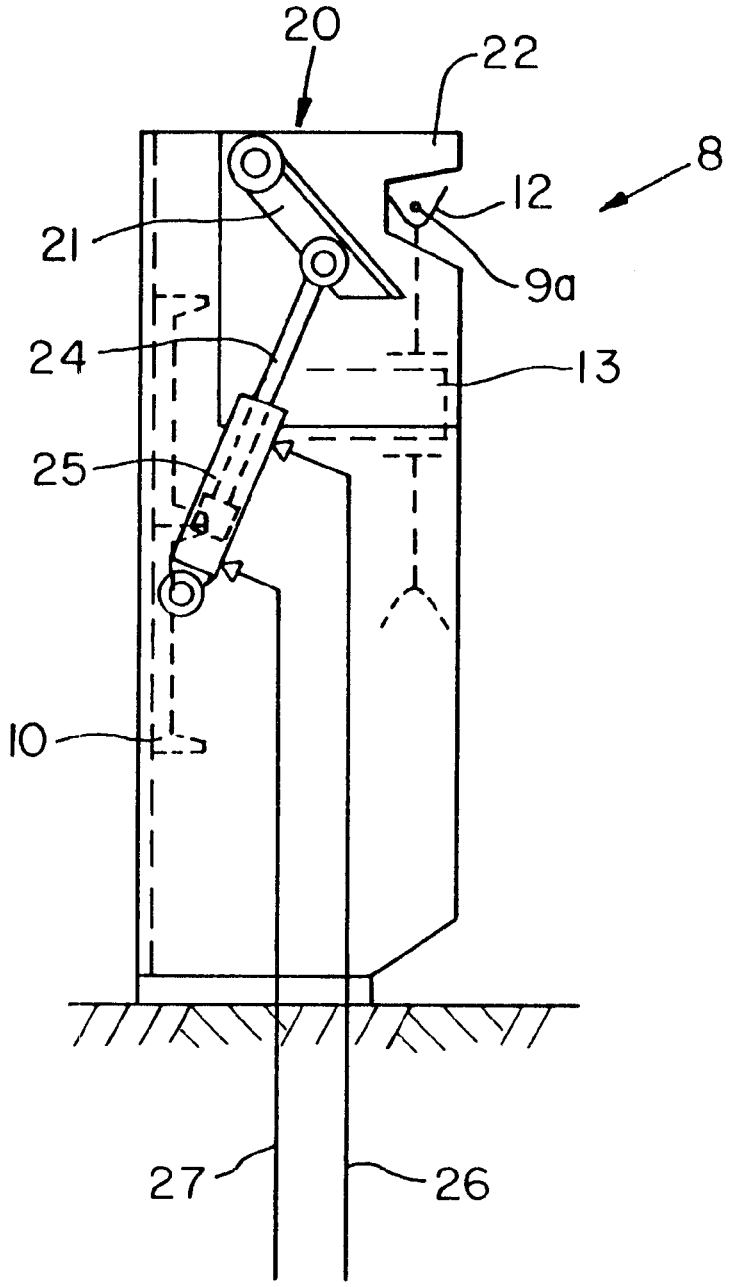
FIG. 2 is a view along arrow II of FIG. 1.

A two position control valve 30 connects pressure source 31 via line 32 and either via line 26 to one side of cylinder 25 for moving (shown in the drawing) and holding knife 21 in its inoperative position as shown in FIG. 2, or via line 27 to the other side of cylinder 25 for actuating knife 21.

If knife 21 is to be actuated, valve 30 is switched over, e.g. pneumatically, by supplying pressure from pressure source 31 via line 33, auxiliary control valve 34 and line 35 to valve 30. This occurs if a signal is transmitted from rope tension measuring device 36 via line 37 to auxiliary control valve 34. As an alternative, the signal may be directly transmitted from measuring device 36 via line 38 to control valve 30.

Measuring device 36 is adapted to measure the tension in rope 9. Normally, the tension in rope 9 is held at a desired value, by maintaining a selected pressure, supplied from pressure source 19, via line 18 to cylinder 15.

If the tension in rope 9 increases to a predetermined excessive tension value (above the desired value), resulting in increased pressure in cylinder 15 and in line 18, measuring device 36 creates the signal to be transmitted by line 37. As an example, measuring device 36 is designed as a pressure switch pilot valve (sometimes called "sequence valve") which connects line 18 to line 37. If the pressure in line 18 exceeds a certain value which can be adjusted, e.g. by setting the force of a spring 39, the signal is generated.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A rope system, comprising:

an endless rope configured to travel through a machine, said endless rope being under tension;

a measuring device to measure said tension in said endless rope; and a rope cutter positioned to sever said endless rope if said measuring device detects in said endless rope a tension which exceeds a predetermined value.

2. The rope system of claim 1, further comprising a rope tensioning device.

3. The rope system of claim 2, wherein said rope tensioning device includes:

a movable sheave, said endless rope being wrapped around said movable sheave;

a cylinder attached to said movable sheave, said cylinder configured to move said movable sheave and thereby alter said tension in said endless rope; and a pressure source supplying pressure to said cylinder, said pressure corresponding to a desired tension value in said endless rope.

4. The rope system of claim 3, wherein said measuring device is configured to measure said pressure in said cylinder.

5. The rope system of claim 4, wherein said measuring device includes a pressure switch, said pressure switch being configured to generate a signal if said pressure in said cylinder exceeds a predetermined value.

6. The rope system of claim 5, wherein said pressure switch is configured to supply said signal to said rope cutter.

7. The rope system of claim 5, wherein said rope cutter includes a cylinder configured to actuate said rope cutter.

8. The rope system of claim 7, further comprising a control valve connected to said cylinder of said rope cutter, said pressure switch being connected to said control valve, said control valve being configured to supply one of pressurized fluid and pressurized gas when said signal is received from said pressure switch.

9. The rope system of claim 8, wherein said signal sent to said control valve is one of a pressurized fluid and a pressurized gas.

10. The rope system of claim 2, wherein said rope cutter is positioned adjacent to said rope tensioning device.

11. The rope system of claim 10, wherein said rope tensioning device has an infeed end, said rope cutter being positioned adjacent said infeed end of said rope tensioning device.

* * * * *